US010004306B1

(12) United States Patent
Randel, Jr.

(10) Patent No.: US 10,004,306 B1
(45) Date of Patent: Jun. 26, 2018

(54) CANE FOR SELF-DEFENSE

(71) Applicant: David Randel, Jr., Live Oak, TX (US)

(72) Inventor: David Randel, Jr., Live Oak, TX (US)

( * ) Notice: Subject to any disclaimer, the term of this patent is extended or adjusted under 35 U.S.C. 154(b) by 0 days. days.

(21) Appl. No.: 15/657,174

(22) Filed: Jul. 23, 2017

(51) Int. Cl.
*A45B 3/14* (2006.01)
*A45B 9/02* (2006.01)
*A45B 9/00* (2006.01)

(52) U.S. Cl.
CPC ..... *A45B 3/14* (2013.01); *A45B 9/02* (2013.01); *A45B 2009/005* (2013.01)

(58) Field of Classification Search
CPC .... A45B 3/14; A45B 9/00; A45B 9/02; A45B 2009/005; A45B 7/00; A45B 7/005
USPC ..... 135/65, 77
See application file for complete search history.

(56) References Cited

U.S. PATENT DOCUMENTS 768,452 A * 8/1904 Hennessy ..... A45B 9/00 135/65
3,177,884 A * 4/1965 Thro ..... A45B 9/04 135/77
3,279,663 A * 10/1966 Torres ..... A45F 5/00 224/251
4,907,614 A * 3/1990 Stamm ..... A45B 9/02 135/15.1
5,025,819 A * 6/1991 Taylor ..... A45B 3/00 135/16
5,197,501 A * 3/1993 Ragatz ..... A45B 3/00 135/66
5,383,587 A * 1/1995 Carpenter ..... A63C 11/02 224/200
5,758,808 A * 6/1998 Epps ..... A45B 1/04 135/66
5,882,056 A * 3/1999 Broadwell ..... A42B 3/006 224/255
6,062,448 A * 5/2000 Balodis ..... A45B 9/00 224/250
6,085,766 A * 7/2000 Geary ..... A01B 1/00 135/68
8,517,555 B1 * 8/2013 LeJeune ..... F21V 33/0068 135/65
2002/0104560 A1 * 8/2002 Kelley ..... A01K 97/06 135/66
2015/0359305 A1 * 12/2015 Shapiro ..... A45B 3/00 428/99

* cited by examiner

*Primary Examiner* — Noah Chandler Hawk
(74) *Attorney, Agent, or Firm* — Spradley PLLC; Michael Spradley

(57) ABSTRACT

An improved cane is disclosed. The improved cane can include a handle, a leg, and grip portions. The handle can attach perpendicularly on top of the leg to form a T-shape. A first portion of the handle can be on a first side of the leg. A second portion of the handle can be on a second side of the leg. The grip portions can have a first grip portion wrapped around the first portion of the handle, a second grip portion wrapped around the second portion of the handle, and a plurality of leg grip portions together extending substantially from a first end of the leg to a second end of the leg and intermittent around a circumference of the leg.

14 Claims, 5 Drawing Sheets

CANE FOR SELF-DEFENSE

BACKGROUND

This disclosure relates to an improved cane for self-defense. A cane or most commonly known as walking stick has been used for ages as a fashion accessory, and as a support to keep one person's balance. Since people who use cane are usually people with walking disabilities, they may appear vulnerable and can become an easy target for criminals. In such situation, cane can be these people main option for personal defense. However, standard canes such as an orthopedic cane, and/or walking sticks are not built for such purpose. First, standard canes are usually lightweight and may not be strong enough when used as a weapon or a defense. Second, since the handles on standard canes are only designed to support the user when walking, the handles are usually curved in shape or are without a direct line of force to the palm when cane is used as a poking device. Lastly, only the handle on standard cane can comprise a grip section while the leg sections can have a smooth finish. Thus, the leg section of a standard cane can be slippery when gripped and may not provide a secure grip when used as weapon. As such it would be useful to have an improved system and method for an improved cane for self-defense.

SUMMARY

An improved cane is disclosed. The improved cane can include a handle, a leg, and grip portions. The handle can attach perpendicularly on top of the leg to form a T-shape. A first portion of the handle can be on a first side of the leg. A second portion of the handle can be on a second side of the leg. The grip portions can have a first grip portion wrapped around the first portion of the handle, a second grip portion wrapped around the second portion of the handle, and a plurality of leg grip portions together extending substantially from a first end of the leg to a second end of the leg and intermittent around a circumference of the leg.

DETAILED DESCRIPTION

Described herein is a system and method for an improved cane for self-defense. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
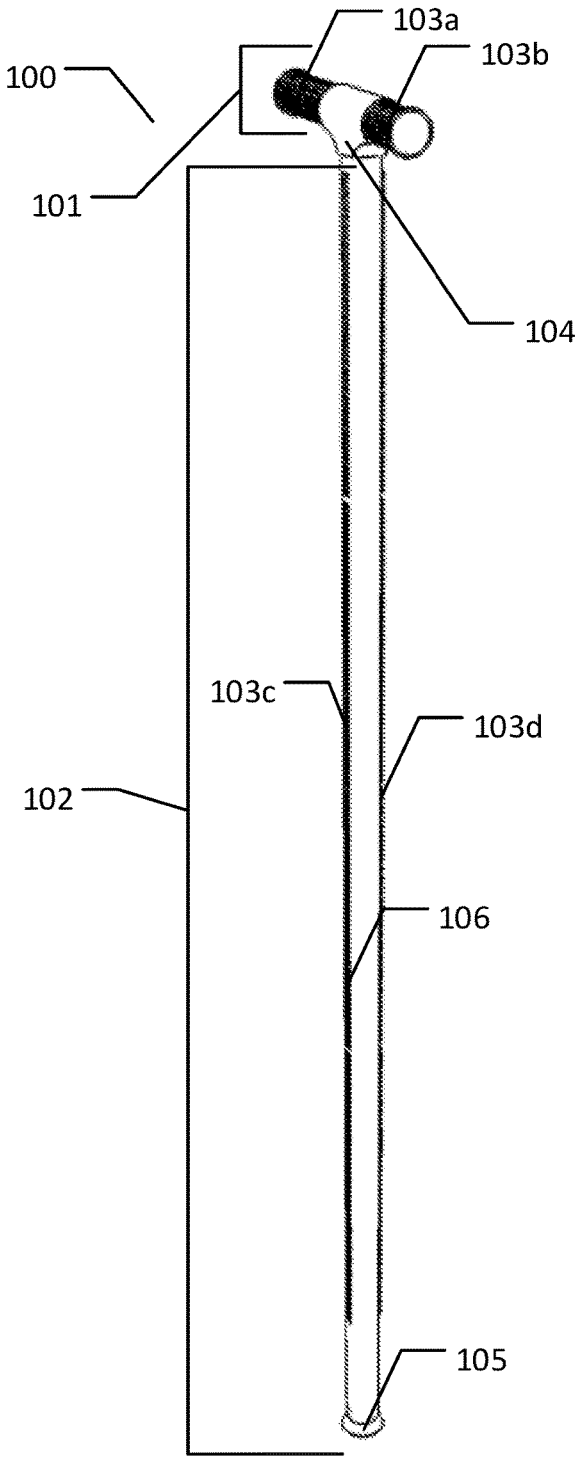
FIG. 1 illustrates a cane comprising a handle and a leg.

FIG. 1 illustrates a cane 100 comprising a handle 101, a leg 102, and a plurality of grip portions 103. Cane 100 can be made of steel metal tubing such as Chromoly. For purposes of this disclosure, Chromoly is stronger and more durable than standard steel tubing, and can weight about 500 grams or 1.2 lbs. As such, using Chromoly as material can allow cane 100 be lightweight but at the same time strong when need as a weapon. Handle 101 can be the top portion of cane 100 that a user can hold onto when cane 100 is used as support for walking. Handle 101 can attach perpendicularly on top of leg 102 forming a T-shape. This feature can allow cane 100 be grasped onto through a split finger grip. In such structure, handle 101 can provide a perpendicular platform for direct line of force when thrusting the cane forward. Moreover, the opposite edges of handle 101 can have a low surface area to provide penetrative force when cane 100 is used in a hammer like fashion. As a non-limiting example, the area of the rim of handle 101 can be 0.096 while the diameter can be 0.601. In such example, the penetrative force can be 6 times more per square inch. In a preferred embodiment, handle 101 and leg 102 can be coping joint welded at a joint section 104. Joint section 104 can be the intersecting section of handle 101 and leg 102. In such embodiment, leg 102 can be attached off-center at the bottom of handle 101. Further, such method of welding allows cane 100 be built as strong as one solid piece of metal. Moreover, joint section 104 and/or handle 101 can be heavier than leg 102, which can allow handle 101 be used as a hitting portion of the cane when cane 100 is used as weapon. Leg 102 can be the long vertical shaft that provides support for cane 100. In one embodiment, the bottom end portion of leg 102 can comprise a washer 105. Washer 105 can cover the bottom end portion of leg 102.

Grip portions 103 can be textured sections in cane 100. Moreover, grip portions 103 can provide secure grip and better control when cane 100 is used as weapon. As an example embodiment as shown in FIG. 1, a first grip portion 103*a* and a second grip portion 103*b* can be at the opposite side ends of handle 101 while a third grip portion 103*c* and a fourth grip portion 103*d* can be at the opposite sides of leg 102. In one embodiment, each grip portion 103 can comprise of grip tape 106. For purposes of this disclosure, grip tape 106 can be an adhesive backed friction-surfaced material attached to cane 100 to provide user more friction to control cane 100. Grip tape 106 can be in variety of styles, color and/or design. In another embodiment, the textured section on grip portions 103 can be applied through method that can include but is not limited to knurling. In one embodiment, cane 100 can be entirely covered with grip portions 103. In another embodiment, only the protruding portions of handle 101 and opposite sides of leg 102 can comprise of grip portions 103. As a non-limiting example, handle 101 can be 4 inches in length. In such non-limiting example, first grip portion 103*a* can be 2 inches in length while second grip portion 103*b* can be 1⅛ inch in length and joint section 104 can be ⅞ inches in length. Further in this non-limiting example, third grip portion 103*c* and fourth grip portion 103*d*, can each be at a ¼ inch width and centered on each side of leg 102 while the top edge of third grip portion 103*c* and fourth grip portion 103*d* on leg 102 can each be ¼ inch away from the bottom of handle 101. In another non-limiting example, grip portions 103*c* and 103*d* on leg 102 can each be 36 inches to 38 inches in length. In such example, only the top portion of leg 102 can be covered with grip portion 103. As such, the bottom portion of leg 102 can be smooth and untextured.

Figure 2:
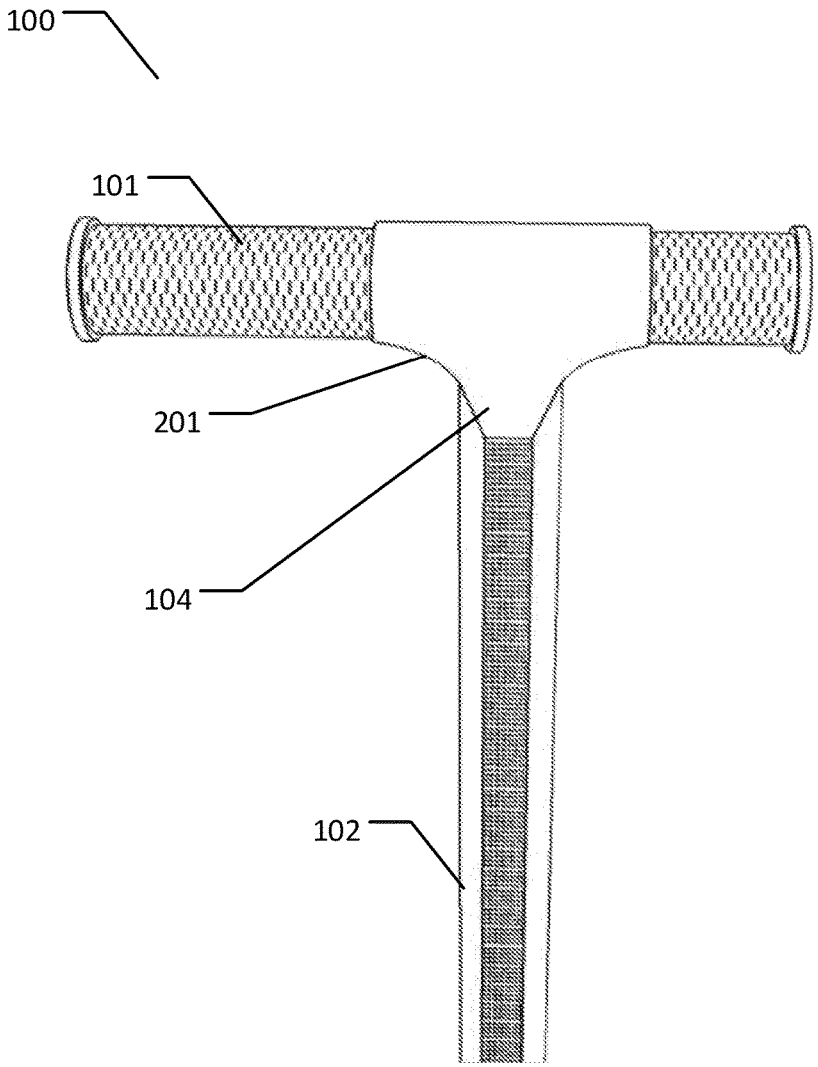
FIG. 2 illustrates a side view of the top section of a cane.

FIG. 2 illustrates a side view of the top section of cane 100. In one embodiment, handle 101 can be attached to leg 102 through method such as TIG (tungsten inert gas) welding. In such embodiment, joint section 104 can form a smooth pair of arcs 201 positioned under handle 101. Arcs 201 can be the inward curved portion that forms at the intersection of handle 101 and leg 102. Such feature can provide finger comfort to users.

Figure 3:
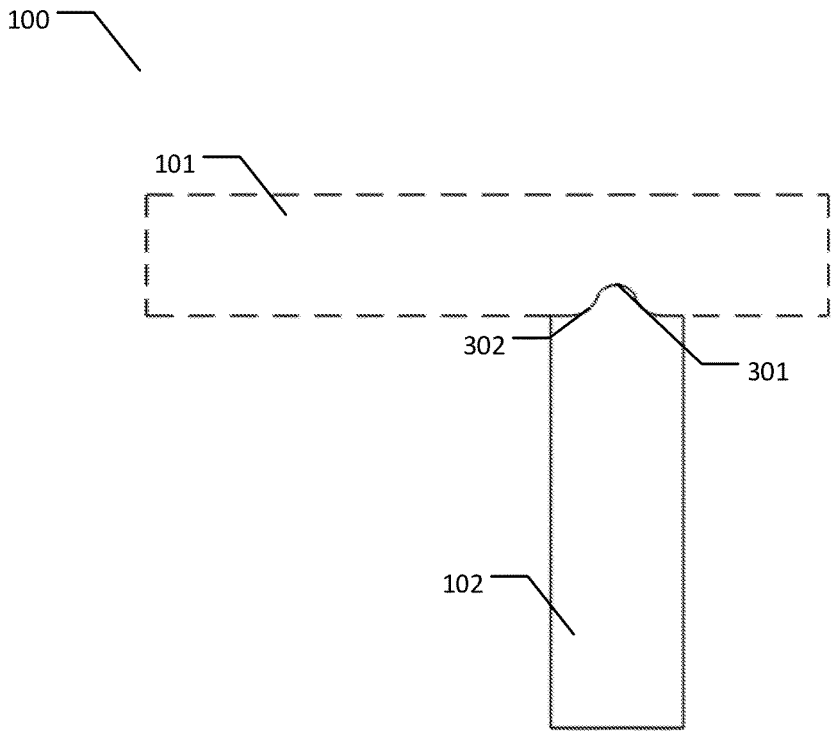
FIG. 3 illustrates a side view of how a handle is attached to a leg.

FIG. 3 illustrates a front view of how handle 101 is attached to leg 102. In this embodiment, handle 101 can comprise a depressed portion 301 while leg 102 can comprise a coped joint 302. Depressed portion 301 can be a curved depression placed at the middle bottom section of handle 101, while coped joint 302 can be a rounded protrusion at the top end of leg 102. Depressed portion 301 can be compatible with coped joint 302. Depressed portion 301 can attach to coped joint 302 through methods that can include but is not limited to adhesion, and/or TIG welding. Such structure prevents sharp edges on joint 104 and at the same time provides a secured attachment (tight joint) between handle 101 and leg 102.

Figure 4:
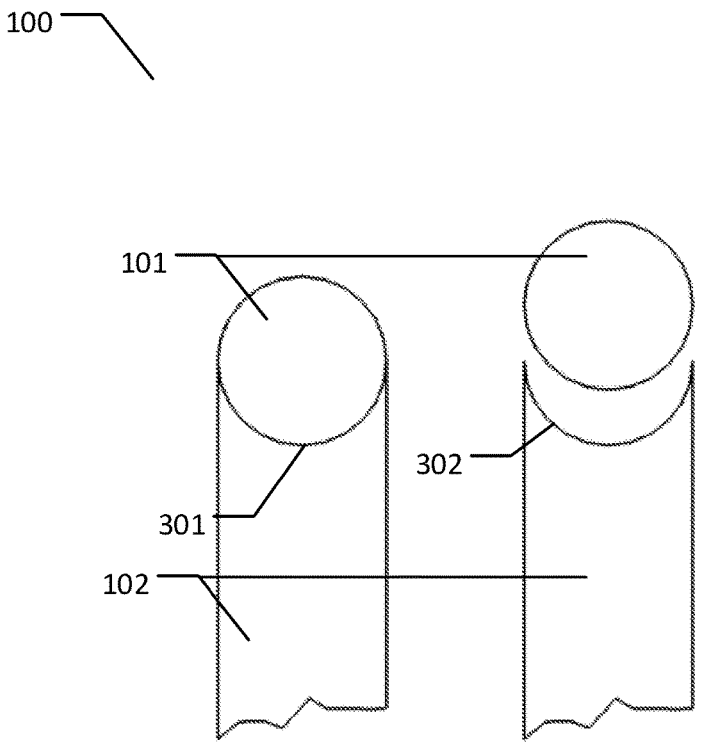
FIG. 4 illustrates a front view of how a handle is attached to a leg.

FIG. 4 illustrates a front view of handle 101 attached to leg 102. Handle 101 mounted snuggly within coped joint 302. Further as a non-limiting example, the outer diameter of handle 101 can be 0.875 inches, the inside diameter of handle 101 can be 0.805, and the wall thickness of handle 101 can be 0.035 inches.

Figure 5:
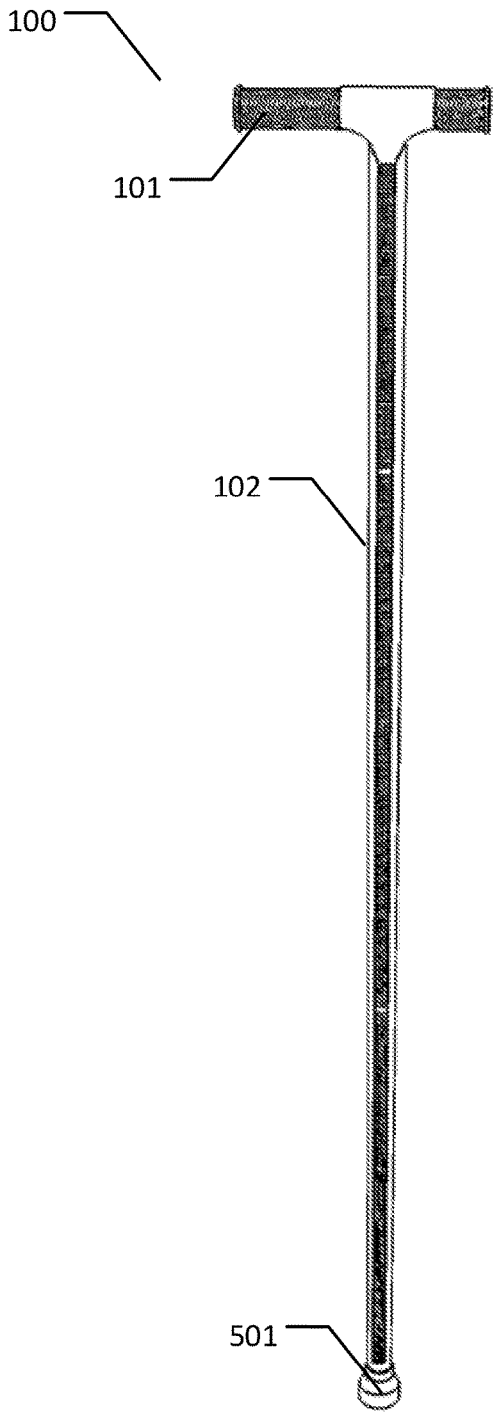
FIG. 5 illustrates a trimmed embodiment of a cane.

FIG. 5 illustrates a trimmed embodiment of cane 100. In one embodiment, Cane 100 can be cut to comfortable height through a steel tubing cutter. In such embodiment, the bottom portion of leg 102 can be trimmed. After trimming the bottom portion of leg 102, washer 105 can be attached at the bottom end of leg 102. Once washer 105 is attached, rubber cap 501 can be mounted at the bottom end of leg 102. As such, washer 105 can prevent the bottom of leg 102 from cutting rubber cap 501. Rubber cap 501 can protect floor from scratches. Moreover, rubber cap 501 can provide friction that prevents slipping.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. An improved cane comprising
a handle;
a leg, said handle attached perpendicularly on top of said leg to form a T-shape, a first portion of said handle on a first side of said leg, further a second portion of said handle on a second side of said leg; and
grip portions comprising
a first grip portion wrapped around said first portion of said handle;
a second grip portion wrapped around said second portion of said handle; and
a plurality of leg grip portions together extending substantially from a first end of said leg to a second end of said leg and intermittent around a circumference of said leg,
wherein said grip portions comprise adhesive grip tape.

2. The cane of claim 1 wherein said handle and said leg are coping joint welded together.

3. The improved cane of claim 1 wherein said handle and said leg are TIG (tungsten inert gas) welded.

4. The improved cane of claim 1 wherein said handle and said leg comprises chromoly steel.

5. The improved cane of claim 1 further comprising a rubber cap covering the bottom end of said leg.

6. The improved cane of claim 5 wherein the bottom end of said leg further comprise a washer, said washer prevents the bottom end of said leg from cutting said rubber cap.

7. The improved cane of claim 1 wherein said first portion of said handle is longer than said second portion of said handle.

8. An improved cane comprising
a handle;
a leg, said handle attached perpendicularly on top of said leg to form a T-shape, a first portion of said handle on a first side of said leg, further a second portion of said handle on a second side of said leg; and
grip portions comprising
a first grip portion wrapped around said first portion of said handle;
a second grip portion wrapped around said second portion of said handle; and
a plurality of leg grip portions together extending substantially from a first end of said leg to a second end of said leg and intermittent around a circumference of said leg,
wherein said grip portions on said handle and said leg are applied by knurling.

9. The cane of claim 8 wherein said handle and said leg are coping joint welded together.

10. The improved cane of claim 8 wherein said handle and said leg are TIG (tungsten inert gas) welded.

11. The improved cane of claim 8 wherein said handle and said leg comprises chromoly steel.

12. The improved cane of claim 8 further comprising a rubber cap covering the bottom end of said leg.

13. The improved cane of claim 12 wherein the bottom end of said leg further comprise a washer, said washer prevents the bottom end of said leg from cutting said rubber cap.

14. The improved cane of claim 1 wherein said first portion of said handle is longer than said second portion of said handle.

* * * * *